United States Patent [19]

Gaube

[11] Patent Number: 5,065,971

[45] Date of Patent: Nov. 19, 1991

[54] HEIGHT ADJUSTABLE PLANT HANGING DEVICE

[76] Inventor: Guy Gaube, 952 Gouin Ouest, Montreal Québec, Canada, H3L 1K8

[21] Appl. No.: 557,636

[22] Filed: Jul. 25, 1990

[51] Int. Cl.[5] ..... B65H 75/00

[52] U.S. Cl. ..... 248/330.1; 248/321; 47/67

[58] Field of Search ..... 248/330.1, 329, 334.1, 248/335, 336, 320, 321; 160/303; 47/67; 242/295, 107.3, 107.4 R, 107.6, 107.7

[56] References Cited

U.S. PATENT DOCUMENTS

| | | | |
|---|---|---|---|
| 1,163,444 | 12/1915 | Newell | 248/330.1 |
| 2,578,374 | 12/1951 | Pratt | 248/330.1 |
| 4,187,996 | 2/1980 | Ehrlich | 248/330.1 X |
| 4,556,184 | 12/1989 | O'Sullivan | 248/330.1 |

FOREIGN PATENT DOCUMENTS

| | | | |
|---|---|---|---|
| 1229484 | 11/1987 | Canada . | |
| 66067 | 6/1892 | Fed. Rep. of Germany | 248/330.1 |
| 11326 | 5/1898 | United Kingdom | 248/330.1 |

*Primary Examiner*—Karen J. Chotkowski
*Attorney, Agent, or Firm*—Samuel Meerkreebs

[57] ABSTRACT

A height adjustable device for suspending a planter comprises a locking member adapted to be mounted above the planter, a handle member and a cable attached at a first end thereof to the planter. The cable passes through the locking member and is wound around a reel biasedly mounted in the handle member with a second end of the cable being attached to the reel. The cable is partly wound around the reel. A disengageable brake is provided for the reel. The locking member comprises a pair of fixed wheels which guide the cable therethrough. The locking member further comprises a locking arm pivotally mounted therein and comprising a series of teeth. The locking arm is biased towards a first one of the wheels, whereby the cable can be secured between the locking arm and the first wheel. Tension provided in the cable by the handle member forces the locking arm away from the cable thereby releasing the same and allowing free movement thereof through the locking member and thus permitting the planter to be raised and lowered. To secure the cable between the teeth of the locking arm and the first wheel, a sudden slack is provided in the cable using the handle member in order to reduce the forces exerted by the cable on the locking arm in such a way that the locking arm is urged towards the wheel to imprison the cable therebetween. The disengageable brake allows the handle member to be positioned at various distances from the locking member by counterbalancing the forces of the biased reel provided in the handle member.

19 Claims, 3 Drawing Sheets

HEIGHT ADJUSTABLE PLANT HANGING DEVICE

BACKGROUND OF THE INVENTION

1. Field of the Invention

The present invention relates to height adjustable devices and, more particularly, to planter hanging devices which can be easily lowered for watering.

2. Description of the Prior Art

Generally, hanging planters are suspended from a hook mounted to the ceiling by three or more ropes, cables or chains which are attached at their lower ends in an equally distributed way along the peripheral upper edge of the planter.

In the above case, the planter is normally at a height where it is difficult for a person to water the plant without water spilling from the planter as the ground level of the planter is located above the eyes of that person.

Devices such as the spool mechanism disclosed in Canadian Patent No. 1,229,484 issued on Nov. 24, 1987 to Kagan allow for the planter to be initially adjusted to the desired height but does not permit the planter to be easily moved down for watering and then moved back up to its initial display position.

Therefore, a presently available locking planter pulley was developed for allowing a planter to be displaced vertically for watering. The locking pulley which is mounted to the ceiling includes a pair of adjacent and coaxial pulley wheels of different diameters. A rope which is threaded through the pulley is attached at one end to the planter and at the other to a handle piece. By manoeuvering the handle piece with the rope at an angle, the rope can be caused to displace from one pulley wheel to the other. When the rope is engaged on the small pulley wheel, the planter can be selectively raised or lowered as the pulley wheel is free to rotate. When the rope engages the large pulley, it becomes jammed between the large pulley and the bracket on which the pulley wheels are journaled thereby locking the planter at a desired height. The excess rope is then manually wound around the handle piece and secured thereto. Although this device allows for the planter to be lowered and raised between display and watering positions, precise manipulations of the handle piece are necessary to lock and unlock the rope. Furthermore, a series of steps are necessary for the storage of the handle piece.

SUMMARY OF THE INVENTION

It is therefore an aim of the present invention to provide an improved planter hanging device that allows the planter to be moved up and down in order to permit easy watering of the plant contained therein.

It is also an aim of the present invention to provide a planter hanging device including a handle which is easily stored.

A construction in accordance with the present invention comprises a height adjustable device for suspending an item. The device comprises a locking member adapted to be mounted above the item, a handle means and a cable means attached at a first end thereof to the item. The handle means comprises a reel means biasedly mounted thereto with a second end of the cable means being attached to the reel means. The cable means is partly wound around the reel means. A disengageable brake means is provided for the reel means. The locking member is adapted for locking the cable means thereto between the first and second ends of the cable means and for allowing movement of the cable means therein when sufficient tension is provided to the cable means by way of the handle means.

Also in accordance with the present invention, there is provided a method for lowering an item suspended from a device. The device comprises a locking member mounted above the item, a handle means and a cable means attached at a first end thereof to the item. The handle means comprises a reel means biasedly mounted thereto with a second end of the cable means being attached to the reel means. The cable means is partly wound around the reel means. A disengageable brake means is provided for the reel means. The locking member is adapted for locking the cable means thereto between the first and second ends of the cable means and for allowing movement of the cable means therein when sufficient tension is provided to the cable means by way of the handle means. The method comprises the following steps. The handle means is first grasped with the brake means being released from the reel means. The handle means is then pulled downwards and away from the locking member in order to unwound the cable means from the reel means. A tension is provided in the cable means when the cable means is unwound from the reel means thereby releasing the cable means in the locking member and allowing the cable means to freely displace therein. The item is then allowed to lower under its own weight while maintaining the cable means taut. At a desired height of the item, the handle means is then manoeuvered in order that the cable means becomes secured into position in the locking member.

BRIEF DESCRIPTION OF THE DRAWINGS

Having thus generally described the nature of the invention, reference will now be made to the accompanying drawings showing by way of illustration only a preferred embodiment of the present invention, and wherein.

DESCRIPTION OF THE PREFERRED EMBODIMENTS

Figures 1, 9:
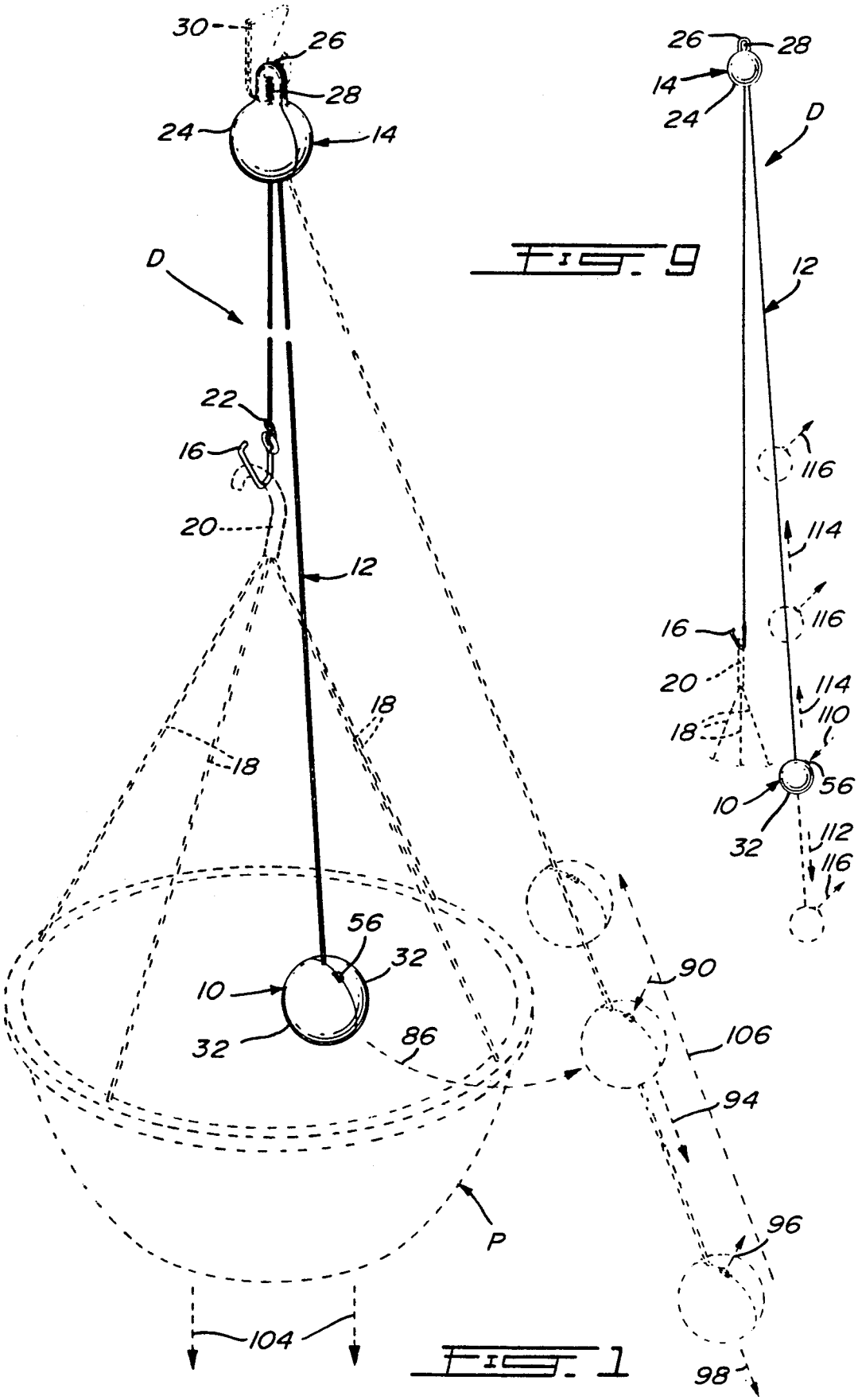
FIG. 1 is a perspective view of a plant hanging device in accordance with the present invention showing in broken lines a planter suspended therefrom and the device being displaced for lowering the planter.
FIG. 9 is a schematic view of the hanging device of FIG. 1 showing in broken lines the handle thereof in various positions.

FIG. 1 illustrates a preferred construction of a plant hanging device D in accordance with the present invention which includes a handle 10, a rope cable 12, a cable locking member 14 and a planter suspending hook 16. A planter P is suspended from the hook 16 by way of four ropes or chains 18 joined to a common hook 20 engaged with the hook 16 which is attached to a first end 22 of the cable 12. The locking member 14 includes a generally spherical housing 24 with a tongue 26 extending upwards therefrom. The tongue 26 defines an oblong opening 28 which allows the locking member 14 and thus the device D to be engaged in a ceiling hook 30 fastened to the ceiling (not shown).

The handle also includes a spherical housing 32, with both the housings 24 and 32 of the locking member 14 and of the handle 10 each comprising two plastic molded snap-on sections encasing internal structures which will be described hereinbelow. A second end 34 of the cable 12 is inserted in the handle 10 with the intermediate section of the cable 12 passing through the locking member 14. The handle 10 and the locking member 14, as indicated hereinabove, are each constituted of a pair of molded semi-spherical plastic shells forming the housing 32 and 24 which are snapped and maintained together by cooperating outer ribs 32*a* and 24*a* and inner ribs 32*b* and 24*b*, respectively, provided on one and the other one of the pairs of semi-spherical shells.

Figure 4:
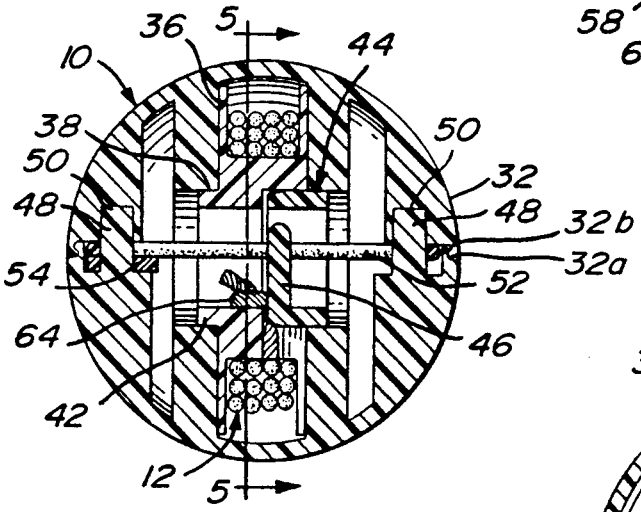
FIG. 4 is a cross-sectional plan view of the handle of FIGS. 2 and 3.
Figure 5:
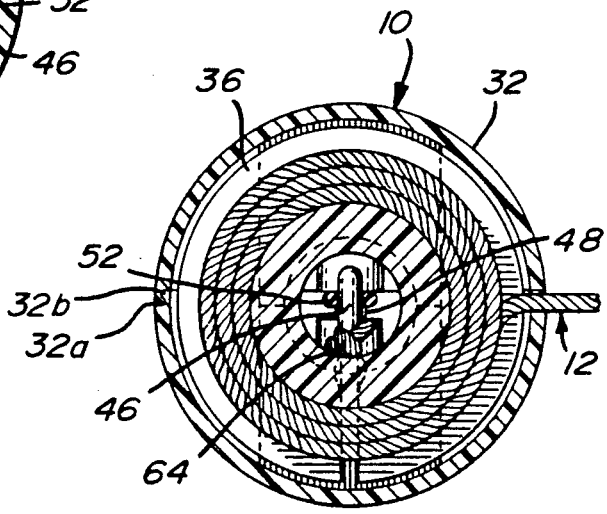
FIG. 5 is a cross-sectional side view of the handle of FIGS. 2 to 4 taken along lines 5—5 of FIG. 4.

Referring to FIGS. 2 to 5 which illustrate various cross-sectional views of the handle 10, a reel 36 includes a tubular cylindrical shaft 38 forming circular shoulders which are journaled in a pair of bushings 40 having halves in each of the two shells of the housing 32 of the handle 10. The shaft 38 comprises a first section 42 which is integral with the reel 36 and a second section 44 constituted of a sleeve frictionally engaged in the reel 36. The second section 44 includes a radially inwardly projecting finger 46, as best seen in FIG. 4.

Figure 2:
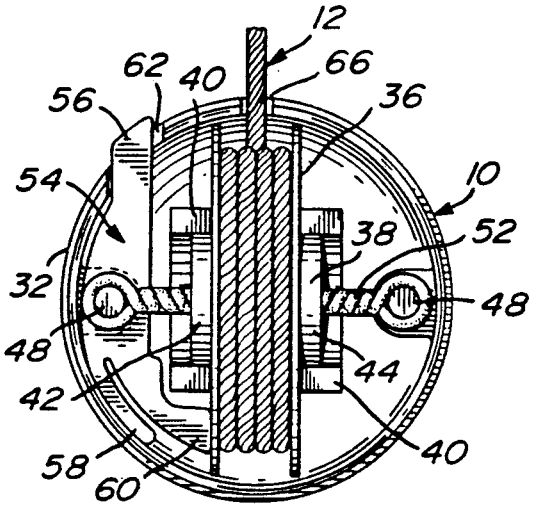
FIGS. 2 and 3 are cross-sectional elevations of the handle of the hanging device of FIG. 1.
Figure 3:
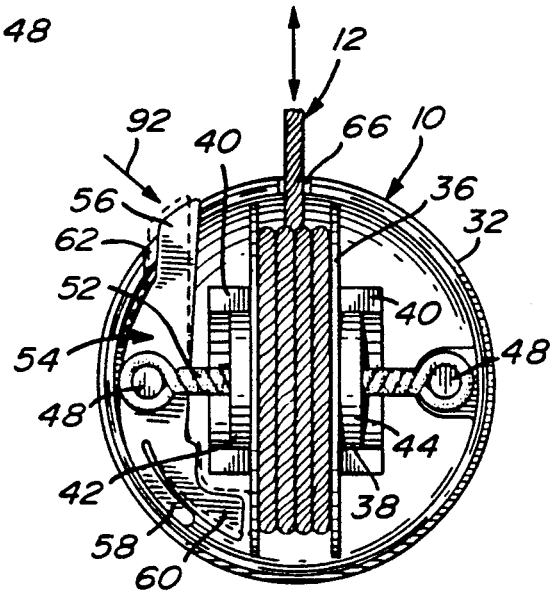

The housing 32 defines two pairs of cooperating pins and holes 48 and 50, respectively, provided in respective ones of the two shells and which are disposed on each side of the reel 36 and the shaft 38. An elastic member 52 passes around both pins 48 and in each side of the finger 46, as seen in FIGS. 2 and 4. A reel brake 54 which is pivotally mounted to one of the pins 48 includes a tab 56, a resilient arm 58 and a contact arm 60 biased by the resilient arm 58 cooperating with the housing 32 in order to bear against the reel 36. The tab 56 projects through an opening 62 defined in the housing 32.

The second end 34 of the cable 12 which includes a knot 64 is secured to the reel 36 by introducing the cable 12 through a slot radially defined along the reel 36 so as to position the knot 64 within the central opening defined by the shaft 38, as seen in FIG. 4. The sleeve section 44 is then introduced in the reel 36 until it bears against the first section 42 thereby imprisoning the cable 12 between the two sections 42 and 44 forming the shaft 38. The reel 36 can then be positioned so that the shaft 38 lies in the bushings 40 with the elastic member 52 being slipped through the shaft 38 of the reel 36, and on each side of the finger 46 following which the elastic member 52 is passed around the pins 48, as seen in FIG. 4. The reel 36 is then wound with the elastic member 52 becoming twisted due to the finger 46, as seen in FIG. 2. The cable 12 extends from the handle 10 through an opening 66 defined in the housing 32.

Figure 6:
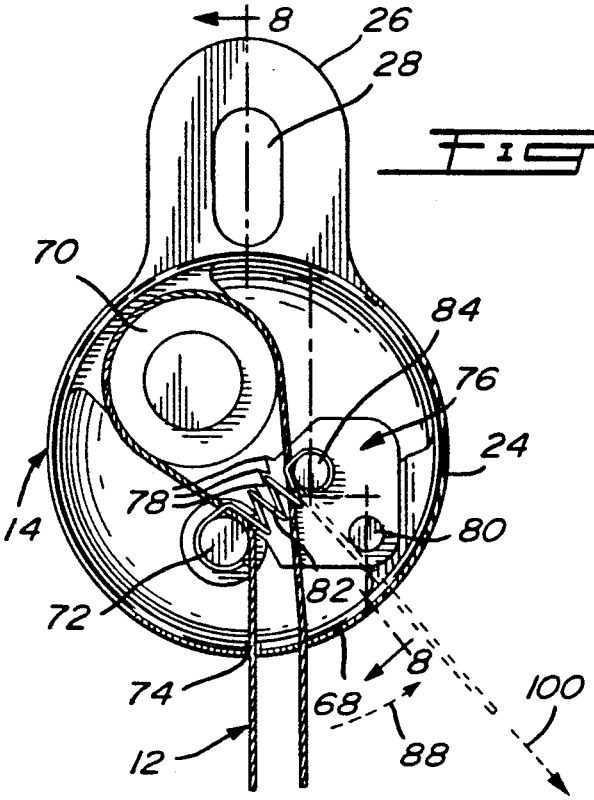
FIGS. 6 and 7 are cross-sectional elevations of the cable locking device of the hanging device of FIG. 1.
Figure 8:
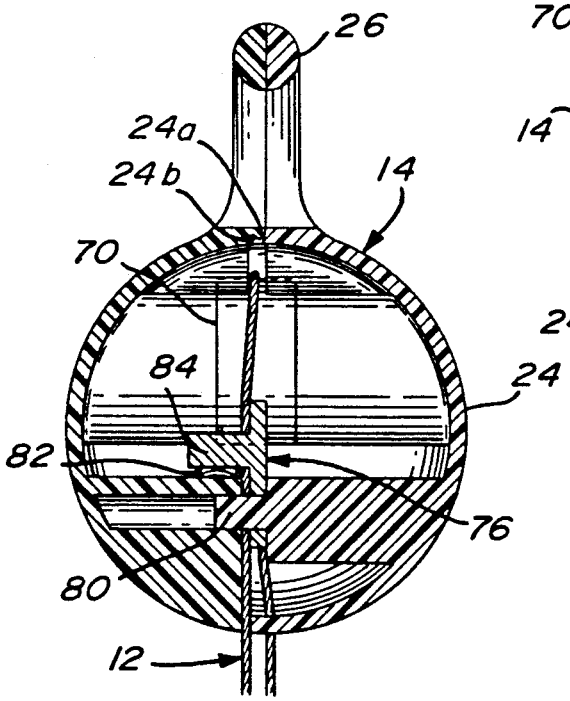
FIG. 8 is a cross-sectional side view of the locking device of FIGS. 6 and 7 taken along lines 8—8 of FIG. 6.
Figure 7:
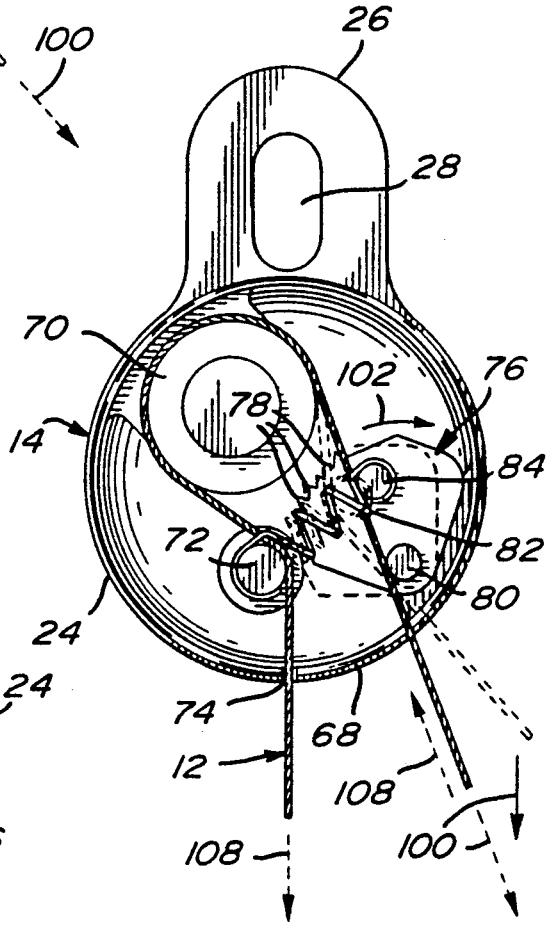

Now referring to FIGS. 6 to 8, the cable 12 enters the locking member 14 through an elongated slot 68 defined in a lower part of the housing 24, passes around a large fixed wheel 70 and is guided by a small fixed wheel 72 before emerging from the locking member 14 through an opening 74 defined in the housing 24.

A locking arm 76 including a series of teeth 78 is pivotally mounted at 80 inside the locking member 14. A spring 82 which extends between the small wheel 72 and a stub 84 provided on the locking arm 76 biases the locking arm 76 towards the cable 12 about the small wheel 72, at which point the cable 12 is secured into position by the teeth 78 engaging the cable 12. The stub 84 also serves to disengage the teeth 78 of the locking arm 76 from the cable 12 contacting the small wheel 72 as will be explained hereinafter.

When it is desired, for instance, to add water to the planter P, the simple following steps are followed:

Referring to FIG. 1, the planter P is in its normal position, generally well over the head of the person which intends to pour water thereinto. The handle 10 and the cable 12 in full lines represent the device D hanging freely prior to its use to lower the planter P.

Therefore, to lower the planter P, the handle 10 is grasped and moved laterally in the direction shown by arrow 86 in FIG. 1 with the cable 12 pivoting about the small wheel 72 along the slot 68, as indicated by arrow 88 in FIG. 6. This pivot represents a natural displacement of the handle 10 as it is necessary for the handle 10 to clear the periphery of the planter P and as the person does not naturally stand directly thereunder. The tab 56 of the reel brake 54 of the handle 10 is then depressed as shown by arrows 90 in FIG. 1 and 92 in FIG. 3, thus forcing the reel brake 54 to pivot about the pin 48 and against the resilient arm 58. Hence, the contact arm 60 pivots away from the reel 36 which allows the handle to be pulled downwards in the direction shown by arrow 94 in FIG. 1. When the cable 12 is completely unwound from the reel 36, the tab 56 can be released as indicated by arrow 96 in FIG. 1. Continuing the downwards pulling motion of the handle 10, as shown by arrow 98 in FIG. 1 and by arrow 100 in FIGS. 6 and 7, tensions the cable 12 (between the gravity forces exerted by the planter P and the pulling force exerted by the person on the handle 10) which abuts the stub 84 of the locking arm 76 of the locking member 14 and forces the locking arm 76 to pivot in the direction shown by arrow 102 in FIG. 7 away from the small wheel 72 thereby releasing the teeth 78 from the cable 12. It is noted that the tension in the cable 12 is sufficient to obviously overcome the force of the spring 82.

The planter P under its own weight is then allowed to lower along arrows 104 of FIG. 1 as the handle 10 displaces along arrow 106 also of FIG. 1 with the cable 12 displacing along arrows 108 of FIG. 7. The weight of the planter P maintains the cable 12 taut, whereby the locking arm 76 remains disengaged from the cable 12, that is in the position shown in FIG. 7.

To lock the planter P in a desired lowered position, a slack is rapidly given to the cable 12 by raising abruptly for a short distance the handle 10, again in the direction of arrow 106. This releases the pressure exerted by the cable 12 on the stub 84, thus allowing the spring 82 to pull on the stub 84 with the locking arm 76 pivoting towards the small wheel 72 in order that the teeth 78 engages the cable 12 which becomes immobilized between the locking arm 76 and the small wheel 72. No tension is obviously provided in the cable 12 by way of the handle 10 in order not to disengage the locking arm 76 from the cable 12. At that point, the planter P can be watered.

When it is desired to raise the planter P, for instance, to its initial position, the handle 10 with the cable 12 still completely unwound therefrom is pulled downwards thereby tensioning the cable 12 and thus dislodging the locking arm 76 from the cable 12. The planter P is raised to the desired height and the cable 12 is then locked into position between the teeth 78 and the small wheel 72 by providing a rapid slack in the cable 12 as explained hereinabove.

To position the handle 10 at its initial storage height, the tab 56 is depressed and the handle 10 is allowed to raise under the force of the elastic member 52 which had been further twisted by the above complete unwinding of the cable 12 from the reel 36. When the handle reaches the appropriate height, the tab 56 is released to allow the reel brake 54 to contact and immobilize the reel 36. The pressure exerted by the reel brake 54 is sufficient to counter the remaining force exerted by the elastic member 52 which is still at least partly twisted about the finger 46. The handle 10 is then allowed to hang freely from the locking member 14, as illustrated in full lines on FIG. 1.

FIG. 9 illustrates the handle 10 in such various equilibrium positions. Initially the tab 56 is depressed along the direction of arrow 110. The handle 10 is then displaced along arrow 112 or arrows 114, that is down or up. Finally, the tab 56 is released (arrows 116) and the handle 10 remains suspended at the selected height. The reel brake 54 exerts enough force on the reel 36 to allow such various vertical positions of the handle 10 even though the spring force in the elastic member 52 is dependent on the relative position of the handle 10 with respect to the locking member 14. It is noted that the spring force is obviously greater when more cable 12 is unwound from the reel 36.

It is understood that the elastic member 52 which, in the illustrations, resembles a soft 0-Ring could be replaced, for example, by an elongated single elastic member provided with openings at both ends thereof and also at its center to respectively engage the pins 48 and the finger 46.

Also, the spring 82 of the locking member 14 could be replaced, for instance, by a resilient plastic pin integral to the housing 24 and extending therefrom to engage at right angles the locking arm 76. Such a pin could be engaged in an aperture or circular recess provided in the stub 84 which is still required for the tensioned cable 12 to force the pivot of the locking arm along arrow 102 of FIG. 7. Therefore, the locking arm would exert flexion forces on the pin which would thus pivot about its junction with the housing 14 to release the teeth 78 from the cable 12. When slack is provided in the cable 12, the resiliency of the pin would force the locking arm against the cable 12 and the small wheel 72.

From the above, it is readily understood that the present invention provides for easy raising and lowering of a suspended planter and for easy locking thereof into position at any of various heights.

I claim:

1. A height adjustable device for suspending an item, comprising a locking guide member adapted to be mounted above the item, a handle means having a reel means biasedly mounted thereto, and a cable means attached at a first end thereof to the item and at a second end thereof to said reel means with said cable means being guided intermediate said first and second ends by said locking guide member, said reel means urging said cable means to partly wind therearound, said locking guide member being adapted locking said cable means thereto between said first and second ends of said cable means for maintaining the item at a desired height, said locking guide member being also adapted for allowing movement of said cable means to displace therein when sufficient tension is provided to said cable means, whereby the item can be selectively lowered or raised, said sufficient tension resulting from a displacement of said handle means relative to said locking guide member that causes said cable means to unwind from said reel means, wherein, when said cable means is secured to said locking guide member, allowing said cable means to wind around said reel means causes said handle means to retract towards said locking guide member.

2. A device as defined in claim 1, wherein said handle means is provided with a disengageable brake means which acts on said reel means.

3. A device as defined in claim 2, wherein said handle means comprises a first housing defining a bushing means, said reel means comprising two outwardly shoulders extending at right angles therefrom and journaled in said bushing means.

4. A device as defined in claim 3, wherein a bias means is provided in said first housing for acting on said reel means.

5. A device as defined in claim 4, wherein an opening is defined centrally through said reel means and said shoulders, said bias means including an elastic member extending through said opening, an elastic member retaining means being provided in order that a rotation of said reel means forces said elastic member to twist thereby biasing said reel means.

6. A device as defined in claim 5, wherein said elastic member is secured to said first housing on opposite sides of said reel means, and wherein said elastic member is further secured to said reel means.

7. A device as defined in claim 6, wherein said elastic member defines an endless loop which passes around a pair of pins provided in said first housing on each side of said reel means, and wherein a finger means extends radially in said opening of said reel means with said elastic member passing on each side of said finger means, whereby, upon a rotation of said reel means, said finger means forces said elastic member to twist thereby biasing said reel means in said handle means.

8. A device as defined in claim 3, wherein one of said shoulders is integral to said reel means with the other one of said shoulders including a removable tubular cylindrical member, said second end of said cable means including an enlarged portion, said reel means including a radial slot, whereby said cable means is mounted to said reel means by sliding engagement thereof in said slot in order to position said enlarged portion in said opening of said reel means, said tubular cylindrical member being inserted in said reel means in order to secure said enlarged portion in said opening between said pair of shoulders.

9. A device as defined in claim 8, wherein said enlarged portion of said second end of said cable means comprises a knot.

10. A device as defined in claim 2, wherein said handle means comprises a first housing with said reel means being rotatably mounted therein, said brake means including an elongated body having a first end thereof protruding through said first housing and a second end thereof bearing against said reel means, said brake means being pivotally mounted in said first housing between said first and second ends thereof and further including a bias means urging said second end against said reel means, said brake means being adapted, upon a displacement of said first end, to force a pivot of said body against the force exerted by said bias means for releasing said second end from said reel means.

11. A device as defined in claim 1, wherein said locking guide member comprises a second housing with upper and lower wheel means being mounted therein, a locking arm biased towards said lower wheel means, said cable means extending from said handle means first passing around said upper wheel means and then between said lower wheel means and said locking arm, a disengagement means being provided to release said cable means from said locking arm when sufficient tension is provided in said cable means by said handle means.

12. A device as defined in claim 11, wherein said locking arm is pivotally mounted in said second housing and includes a series of teeth engaging said cable means, a bias means being provided for urging said teeth against said cable means and said lower wheel means, said disengagement means comprises a pin means extending from said locking arm and adapted to be subjected to a lateral force from said cable means when said cable means is tensioned, whereby said pin means and thus said locking arm displace against a force exerted by said third bias means thereby releasing said teeth from said cable means.

13. A device as defined in claim 12, wherein said bias means is an extended coil spring provided between said lower wheel means and said locking arm.

14. A device as defined in claim 13, wherein said coil spring is attached to said pin means of said locking arm.

15. A device as defined in claim 1, wherein said locking guide member and said handle means each comprise a housing including a pair of halves which are snapped one to the other.

16. A device as defined in claim 15, wherein said halves are made of molded plastic.

17. A device as defined in claim 16, wherein said halves are semi-spherical and comprise cooperating peripheral means for maintaining said halves together.

18. A method for vertically displacing an item suspended from a device which comprises a locking guide member mounted above the item, a handle means and a cable means attached at a first end thereof to the item and at a second end thereof to a reel means biasedly mounted to said handle means, said cable means being guided by said locking guide member and also being partly wound around said reel means, said locking guide member being adapted for locking said cable means thereto between said first and second ends of said cable means and also for allowing movement of said cable means therein when sufficient tension is provided to said cable means by way of said handle means, the method comprising the following steps for lowering the item:

a) grasping said handle means and pulling said handle means away from said locking guide member in order to unwind said cable means from said reel means, b) providing tension in said cable means when said cable means is unwound from said reel means thereby releasing said cable means in said locking guide member and allowing said cable means to displace therein, c) allowing the item to lower under its own weight by raising said handle means while maintaining the cable means taut, and d) at a desired height of the item, manoeuvering said handle means in order that said cable means becomes secured into position in said locking guide member.

19. A method as defined in claim 18, wherein the item is then raised with the following steps:

e) pulling said handle means downwards with said cable means being taut to release said cable means in said locking guide member, f) further pulling said handle means with said cable means remaining taut until the item is at a desired height, g) manoeuvering said handle means to secure said cable means to said locking guide member, h) releasing a disengageable brake means from said reel means and allowing said biasedly mounted reel means to wind said cable means therearound, and i) at a desired height of said handle means, engaging said brake means to said reel means.

* * * * *

UNITED STATES PATENT AND TRADEMARK OFFICE

CERTIFICATE OF CORRECTION

PATENT NO. : 5,065,971

DATED : November 19, 1991

INVENTOR(S) : Guy GAUBE

It is certified that error appears in the above-identified patent and that said Letters Patent is hereby corrected as shown below:

On the title page:

Item [30] Foreign Application Priority:

July 13, 1990 [CA]
Canada 2,021,123

Signed and Sealed this

Fifth Day of March, 1996

Attest:

Bruce Lehman

BRUCE LEHMAN

Attesting Officer

Commissioner of Patents and Trademarks